US009948032B2

(12) United States Patent
Wimmer et al.

(10) Patent No.: US 9,948,032 B2
(45) Date of Patent: Apr. 17, 2018

(54) ELECTRICAL PLUG CONNECTOR OPTIMIZED FOR INSTALLATION

(71) Applicant: Lisa Draexlmaier GmbH, Vilsbiburg (DE)

(72) Inventors: Stefan Wimmer, Hohenthann (DE); Robert Saller, Egglkofen (DE); Christian Wimmer, Schalkham (DE); Stefan Rieder, Nandlstadt (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/465,930

(22) Filed: Mar. 22, 2017

(65) Prior Publication Data

US 2017/0279225 A1 Sep. 28, 2017

(30) Foreign Application Priority Data

Mar. 23, 2016 (DE) ..... 10 2016 105 504

(51) Int. Cl.
*H01R 13/625* (2006.01)
*H01R 13/639* (2006.01)
*H01R 13/53* (2006.01)

(52) U.S. Cl.
CPC ..... *H01R 13/6395* (2013.01); *H01R 13/53* (2013.01)

(58) Field of Classification Search
CPC .. H01R 13/53; H01R 13/6395; H01R 13/639; H01R 13/62; H01R 13/641; H01R 13/6275; H01R 13/62905
USPC ..... 439/347, 137, 138
See application file for complete search history.

(56) References Cited

U.S. PATENT DOCUMENTS 4,815,306 A * 3/1989 Feichtiger ..... E05B 77/50 70/240
5,375,863 A * 12/1994 Chapman ..... F16M 11/42 180/234
6,666,698 B2 * 12/2003 Beck, Jr. ..... H01R 13/62938 439/157
8,016,607 B2 * 9/2011 Brown, II ..... B60L 11/1818 439/34

(Continued)

FOREIGN PATENT DOCUMENTS

DE 20 2010 018 115 U1 4/2014
DE 10 2015 104 377 A1 9/2016
DE 10 2015 114 080 A1 3/2017

*Primary Examiner* — Abdullah Riyami
*Assistant Examiner* — Vladimir Imas
(74) *Attorney, Agent, or Firm* — Finnegan, Henderson, Farabow, Garrett & Dunner LLP

(57) ABSTRACT

An electrical plug connector for a vehicle comprises a plug with a plug casing in which a contact chamber is formed, an electrical contact part arranged in the contact chamber, a locking bolt for releasably attaching a plug-in contact to the contact part, and a socket to be plugged with the plug, a socket casing and a plug-in contact attached thereto. The plug connector has a locking slide attachable to the plug casing that is mounted on the casing for displacement at least into a locking position in a direction transverse to the plugging direction of the plug, to lock the plug to the socket. The locking slide has a guide slot extending substantially transversely to the plugging direction and having an inclined plane to guide the locking bolt of the contact part as it is moved into the locking position.

20 Claims, 5 Drawing Sheets

(56) References Cited

U.S. PATENT DOCUMENTS

| | | | | |
|---|---|---|---|---|
| 8,235,744 | B1 * | 8/2012 | Liptak | H01R 13/639 439/352 |
| 8,851,924 | B2 * | 10/2014 | Fleischmann | F04D 25/08 439/587 |
| 8,858,258 | B2 * | 10/2014 | Stokowski | H01R 13/42 439/582 |
| 8,876,539 | B2 * | 11/2014 | Gette | H01R 13/453 439/137 |
| 8,894,426 | B2 * | 11/2014 | Gette | H01R 13/447 439/137 |
| 8,951,062 | B2 * | 2/2015 | Fleischmann | H01R 13/585 439/465 |
| 8,956,192 | B2 * | 2/2015 | Eckel | H01R 13/44 439/686 |
| 8,961,213 | B2 * | 2/2015 | Retailleau | H01R 13/6276 439/345 |
| 8,968,021 | B1 * | 3/2015 | Kennedy | H01R 13/6273 439/352 |
| 9,337,580 | B2 * | 5/2016 | Temmesfeld | B60L 3/0061 |
| 9,368,897 | B2 * | 6/2016 | Schwan | H01R 13/4362 |
| 9,401,564 | B2 * | 7/2016 | Blakborn | H01R 13/627 |
| 9,574,382 | B2 * | 2/2017 | Behnke | E05B 83/42 |
| 2015/0295355 | A1 * | 10/2015 | Temmesfeld | B60L 3/0061 439/304 |
| 2016/0285178 | A1 | 9/2016 | Wimmer | |
| 2017/0062980 | A1 | 3/2017 | Wimmer | |

* cited by examiner

ELECTRICAL PLUG CONNECTOR OPTIMIZED FOR INSTALLATION

CROSS REFERENCE TO RELATED APPLICATIONS

This application is based upon and claims the benefit of prior German Patent Application No. 10 2016 105 504.2, filed on Mar. 23, 2016, the entire contents of which are incorporated herein by reference.

TECHNICAL FIELD

The present disclosure relates to an electrical plug connector, in particular to a high-voltage plug connector for a vehicle. The connector of the present disclosure can be used for a plug connection in a high-voltage on-board electrical system of a vehicle, for example a motor-driven, hybrid or electric vehicle. For example, the present disclosure may be applied to the electrical contacting of the plug connector with a drive unit or a motor of the vehicle.

BACKGROUND

Plug connections and plug connectors for use in a high-voltage on-board electrical system are known. For example, German patent applications DE 10 2015 104 377.7 and DE 10 2015 114 080.2 describe an electrical plug connector that is suitable for use in a high-voltage on-board electrical system. The electrical connector has a contact part with a sleeve that forms a receiving space in which a plug-in contact is guided in a direction of insertion. A contact spring is attached in the interior of the sleeve and is adapted to be urged by a displaceable locking bolt in the direction of the receiving space for the plug-in contact. The electrical plug connector equipped with this contact part facilitates insertion and withdrawal of the plug-in contact.

German patent document DE 20 2010 018 115 U1 discloses a plug connector in which a plug and a socket are locked together by a locking slide that can be pushed to the socket transversely to a plugging direction of the plug. However, the plug suffers from various drawbacks. For example, improved resistance to vibration would be desirable.

SUMMARY

Embodiments of the present disclosure provide a plug connector using simpler construction that displays good vibration resistance and is easier to install.

Embodiments of the present disclosure provide an electrical plug connector, which may be used as a high-voltage plug connector in a high-voltage on-board electrical system of a vehicle. The electrical plug comprises a plug with a plug casing made of plastic in which at least one contact chamber is formed. The plug casing, may also encompass two or more contact chambers, depending on whether the plug connector is a one-pole, two-pole, three-pole or multi-pole connector. The electrical plug connector may also include at least one electrical contact part to position in the one or more contact chambers. The contact part has a locking bolt to releasably attach a plug-in contact to the contact part. For example, a contact part of this type is described in German patent application DE 10 2015 104 377 and in German patent application DE 10 2015 114 080, the entire contents of which are incorporated herein by reference. The contact part has a high current-carrying capacity of up to 180 amperes at 85° C. In this connection, "high-voltage" may be understood to be an electric tension amounting to at least approximately 48 V, and may be 60 V or more, or 400 V up to approximately 650 to 1000 V. An on-board electrical system of this type is found, for example, in subsystems in a motor vehicle or for drive and auxiliary power units in a hybrid or electric vehicle.

According to embodiments of the present disclosure, the electrical plug connector also includes a mating socket to be plugged together with the plug. The socket has a casing made of plastic and the plug-in contact attached to the casing for connection to the contact part of the plug.

According to embodiments of the present disclosure, the electrical plug connector includes a locking slide adapted for attachment to the plug casing. The locking slide is mounted on the casing to slide transversely to the plugging direction of the plug into the socket at least into a locking position to lock the plug to the socket. This defines a sliding direction of the locking slide. According to the present disclosure, the locking slide has a guide slot extending essentially transversely to the plugging direction, for example in the sliding direction, with an inclined plane to guide the locking bolt of the contact part as it is moved into the locking position. An inclined plane in this context is understood as the common physical definition of an inclined or sloping plane, i.e. a planar surface that is inclined against a horizontal, such as a sliding plane of the locking slide.

According to embodiments of the present disclosure, the locking bolt of the contact part of the plug can be mechanically guided by the locking slide and moved into the locking position in which not only is the plug-in contact attached to the contact part, but the plug is also locked to the socket. Thus, the locking bolt, which otherwise can only be reached with difficulty using a tool or a bare hand, is carried along with the motion of the locking slide. The locking slide thus carries out several functions in the electrical plug connector, such as locking the plug to the socket and guiding the locking bolt. In addition, the inclined plane of the guide slot for the locking slide significantly reduces the locking forces required to move the locking slide into the locking position. As a result, the force exerted for locking can be lowered as a function of an angle of inclination of the sloping plane, improving ease of installation.

According to embodiments of the present disclosure, the locking slide may be movable into three different positions, or rather it can assume three different positions, namely: a locking position as described above, a secondary locking position in which the contact part is secondarily locked in the contact chamber by the locking slide, and an installed position in which the locking slide is held on the plug casing but leaves the contact chamber open, thus allowing the contact part to be inserted. In some embodiments, the installed position is connected upstream of the secondary locking position, which in turn may be upstream of the locking position.

According to embodiments of the present disclosure, the inclined plane of the guide slot may be situated between a first linear segment for receiving the locking bolt and a second linear segment associated with the locking position. The guide slot is thus substantially Z-shaped. The first linear segment is provided for the insertion or accommodation of the locking bolt of the contact part, for example when the locking slide is in the secondary locking position. The second linear segment serves to hold or clamp the locking bolt in the locking position, in which both the locking bolt of the contact part and the plug are locked to the socket. The linear segments can be aligned horizontally particularly referred to a plane of displacement extending in the direction of displacement. Here the inclined plane forms an angle of inclination to this horizontal.

According to embodiments of the present disclosure, the inclined plane may have an angle of inclination, for example, of approximately 30° to 60°, or approximately 45° relative to the first and/or second linear segment or to a horizontal in the plane of displacement. At this angle of inclination the locking force necessary to move the locking slide can be reduced to a measure that permits easy installation. As a result, the plug connector can be handled with relatively little force exerted.

According to embodiments of the present disclosure, in order for the primarily locking contact part to be held more securely in the contact chamber upon being inserted into the contact chamber, the locking slide secondarily locks the contact part in the contact chamber in a secondary locking position upstream of the locking position. The locking slide automatically secondarily locks the contact part in the contact chamber when it is moved from its installation position into the secondary locking position. In this way, the contact part is securely held in the contact chamber without any additional installation measures becoming necessary.

According to embodiments of the present disclosure, the contact part can be secondarily locked with a secondary locking rib on a side of the locking slide facing the plug casing. This secondary locking rib secondarily locks the contact part in the contact chamber, for example, undercutting it, on a side opposite the direction of plugging. The secondary locking rib may be formed on the plug casing, or cast on and shaped so as to hold the contact part in the contact chamber and to press it against a plug casing wall, thereby causing the contact part to be clamped quickly. In order for the locking slide to perform several functions in the three positions described above, the plug casing may have at least one first longitudinal rib extending in the plugging direction and at least one second longitudinal rib arranged parallel to the first for interaction with the locking slide. For example, the first and/or second longitudinal rib serves to engage the locking slide or a part thereof and/or to guide the locking slide and/or to guide the socket relative to the plug casing.

According to embodiments of the present disclosure, to enable the locking slide to engage in one or more of the above described positions on the plug casing, the locking slide may be provided with one or more detent lugs adapted to releasably latch onto the first and/or second longitudinal rib of the plug casing. The one or more detent lugs may be formed or cast onto the locking slide.

According to embodiments of the present disclosure, for easier installation of the plug connector the one or more detent lugs engage behind the second longitudinal rib in a secondary locking position upstream of the locking position in the direction of displacement of the locking slide. In the secondary locking position the contact part is held in the contact chamber by the locking slide and this position is secured by the engagement of the detent lug on the second longitudinal rib. As a result, the locking slide cannot be easily moved back into the installation position, i.e. if at all, then only through increased exertion of force.

According to embodiments of the present disclosure, for good or intuitive installing capability of the plug connector the one or more detent lugs engage behind the first longitudinal rib in an installation position upstream of the locking position in the direction of displacement of the locking slide. For example, the one or more detent lugs can be arranged and engage in the installation position between the first and the second longitudinal ribs. In this way, the locking slide is held in the installation position on the plug casing, making it easier to handle during the installation.

According to embodiments of the present disclosure, the locking slide leaves the contact chamber open in the installation position, in which it is already latched to the plug casing. In this way the contact part can be inserted into the contact chamber even when the locking slide is already engaged.

According to embodiments of the present disclosure, to ensure that the plug is securely engaged with the socket and to confirm that the plug connection has been correctly completed, the locking slide may have a resilient position-assurance arm which only permits displacement into the locking position if it is released by excursion from engagement with the first and/or second longitudinal rib. For example, the position-assurance arm may have a position-assurance lug that engages with one of the two longitudinal ribs or with both the first and the second longitudinal ribs, particularly in the secondary locking position. The position-assurance lug may be arranged between the first and the second longitudinal ribs in the secondary locking position, so that the locking slide cannot be moved either into the installation position or into the locking position, as it has been blocked by the position-assurance arm. Thus, the locking slide fulfills the additional function of what is referred to as a connector position assurance (CPA). Therefore, depending on the design of the plug connector, a combination of secondary locking and CPA is created.

According to embodiments of the present disclosure, to enable the function as a CPA the locking rib may be formed in such a manner that it is guided between the first and the second longitudinal ribs when the plug is inserted into the socket. This may further improve the ease of installation, since the socket or the socket casing is guided in the plugging direction by the plug or the plug casing.

According to embodiments of the present disclosure, the plug and the socket locked to the plug may be at least partially encased in a protective housing to improve resistance to vibration. The housing may also enable contacting a drive unit or a motor. In some embodiments, there is a positive connection between the plug casing and the protective housing and/or between the socket casing and/or the protective housing, with the result that the plug and the socket are additionally fixed in place by the protective housing. In some embodiments, the protective housing has a fastening flange by which the housing may be affixed to a counterpart such as a counter-housing of a motor or the like.

The present disclosure also relates to a plug connection and to a vehicle having a plug connector in one or more of the embodiments described above.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

The drawings depict merely schematic representations and serve only to illustrate the present disclosure. The same or similar elements are provided throughout with the same reference numbers.

Figure 1:
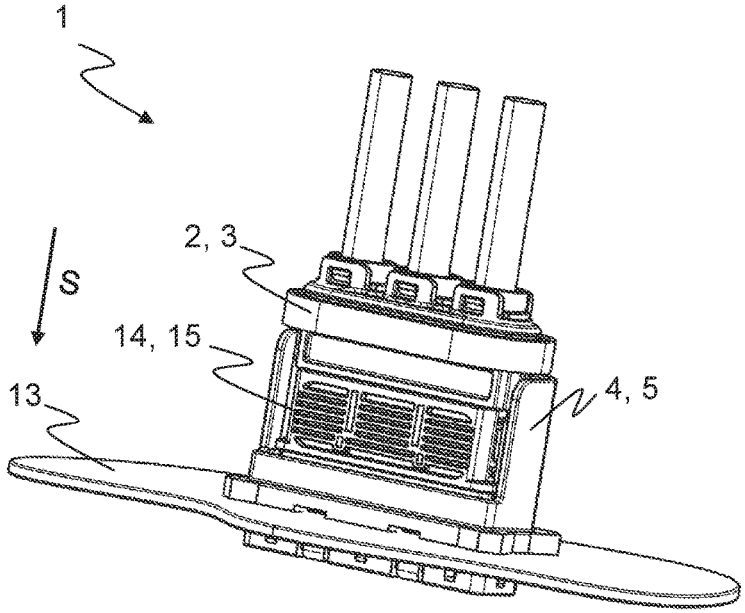
FIG. 1 shows a perspective front view of an exemplary electrical plug connector, with a plug that is locked by a locking slide to a socket affixed to a counterpart.

FIG. 1 shows a perspective front view of an electrical plug connector 1 that is suitable for use as a high-voltage plug connector in a high-voltage wiring system of a vehicle.

The plug connector 1 comprises a plug 2 with a plug casing 3 and a mating socket 4, also referred to as a header, with a socket casing 5. At least one electrical contact part 7 (hidden in FIG. 1 by the plug casing 3; see FIG. 6) is accommodated in at least one contact chamber 6 (shown in FIG. 4) of the plug casing 3. In this embodiment the plug connector has three poles and therefore includes a total of three contact chambers 6 in the plug casing 3 and three contact parts 7. For this reason, the plug connector 1 also has three electric wires connected to the contact parts 7. The plug 2 and the socket 4 may be releasably plugged together in a plugging direction S. While in the plugged state, they may be optionally locked together to establish a plugged connection formed by the plug connector 1.

The contact part 7 has a sleeve 8 (see FIG. 6) that forms a receiving space for a plug-in contact 10 to be guided in a direction of insertion. A contact spring is attached in the interior of the sleeve 8 and is adapted to be pushed by a slid able locking bolt 12 in the direction of the receiving space for the plug-in contact 10. The plug-in contact 10 in this embodiment is part of the socket 4 (see FIG. 2B). As an example, the contact part 7 is described in further detail in German patent applications DE 10 2015 104 377.7 and DE 10 2015 114 080.2, the entire contents of which are incorporated herein by reference.

FIG. 1 shows that the socket 4, acting as a header, is passed through a counterpart 13 with a section facing away from the plug 2, which could be a counter-housing of a motor or the like. The socket 4 is held in a clip connection on the counterpart 13 and lies on the counterpart 13 with a support flange (not shown). A locking slide 14 provided to lock the plug 2 on or to the socket 4 is attached to the plug casing 3 and is displaceable relative to the plug casing 3. The locking slide in this embodiment fulfils several functions, as described below. The plug 2 can also be directly attached to the counterpart 13 by locking it to the socket 4.

Figure 2A:
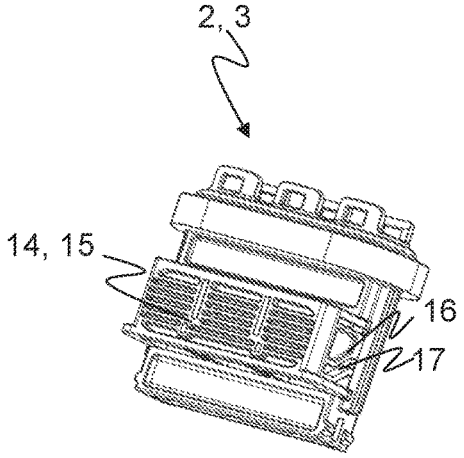
FIG. 2A is a perspective front view of an exemplary plug with a locking slide.

FIG. 2A shows a perspective front view of the plug 2 as an individual part with the locking slide 14 in position for installation. As shown, in this position the locking slide 14 is already being held on the plug casing 3, but a base part 15 of the locking slide 14 is spaced apart from the exterior of the plug casing 3. In this installation position no contact part 7 has yet been inserted into the plug casing 3.

Figure 2B:
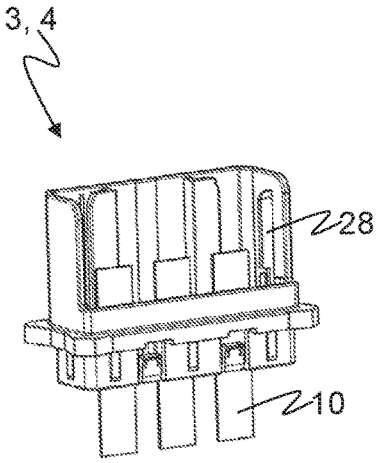
FIG. 2B is a perspective front view of an exemplary socket with plug-in contacts to plug together with a plug.

FIG. 2B shows a perspective front view of the socket 4 as an individual part. As shown, the socket casing 5 has a total of three plug-in contacts 10 for the three-pole plug connector 1.

Figure 3:
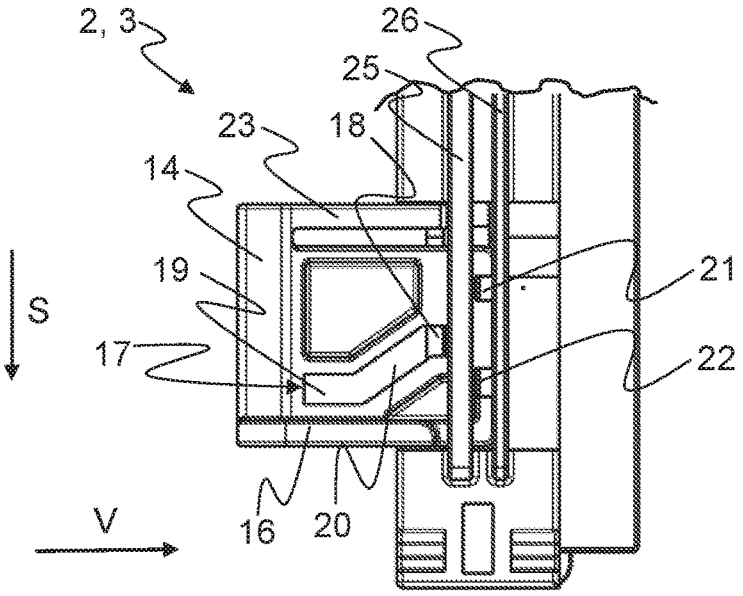
FIG. 3 is a lateral view of an exemplary plug with a locking slide, shown in position for installation.

FIG. 3 shows a lateral view of a partial section of the plug 2 in its installation position. As shown, the base part 15 of the locking slide 14 is spaced apart from the outside of the plug casing 3. Furthermore, a side part 16 of the locking slide 14 extends from the base part 15 on which it is formed in a direction transverse to the plugging direction S of the plug 2. The locking slide 14 here is symmetrical, such that it has an additional side part (not shown or indicated). The side part 16 has a guide slot 17 with a first linear segment 18 and a second linear segment 19 delimiting an inclined plane 20 between the segments. The inclined plane 20 has an angle of inclination relative to the linear segments 18, 19 that measures approximately 45°, but other angles are also contemplated. The guide slot 17 accommodates, guides, and alternatively affixes an axial end of the locking bolt 12 of the contact part 7 (not visible in FIG. 3).

FIG. 3 shows that the side part 16 of the locking slide 14 has a first detent lug 21 and a second detent lug 22 projecting perpendicular to the plugging direction S, i.e. from the drawing plane of FIG. 3. Furthermore, the side part 16 has a position-assurance arm 23. The position-assurance arm 23 may be resilient such that the locking slide 14 performs the function of a connector position assurance (CPA), which is explained in greater detail below. The position-assurance arm 23 is formed at an axial end on the base part 15 and has a position-assurance lug 24 (see FIG. 5) that acts as a detent on an opposite free axial end. The position-assurance lug will is explained in greater detail below.

FIG. 3 also shows that the plug casing 3 has a molded-on first longitudinal rib 25 and a molded-on second longitudinal rib 26. The ribs 25, 26 are arranged in a parallel, spaced relationship to one another and extend in the plugging direction S of the plug 2. In the installation position of the locking slide 14 shown here, the two detent lugs 21, 22 are engaged between the first longitudinal rib 25 and the second longitudinal rib 26, so that the locking slide 14 is held on the plug casing 3. The position-assurance lug 24 may be pushed past the first longitudinal rib 25, since it has a recess on the side facing the position-assurance arm 23 (hidden in FIG. 3 by the first longitudinal rib 25).

Figure 4:
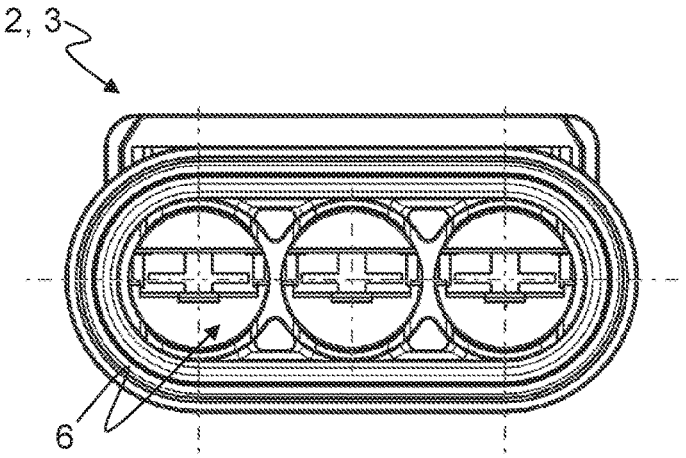
FIG. 4 is a plan view of an exemplary plug with a contact chamber to receive an electrical contact part of the plug.

In a plan view onto the plug 2, FIG. 4 shows that the contact chamber 6 is open as seen in the installation position of the locking slide 14 shown here. Therefore, in this position the contact part 7 may be introduced into the contact chamber 6 of the plug casing 3.

Figure 5:
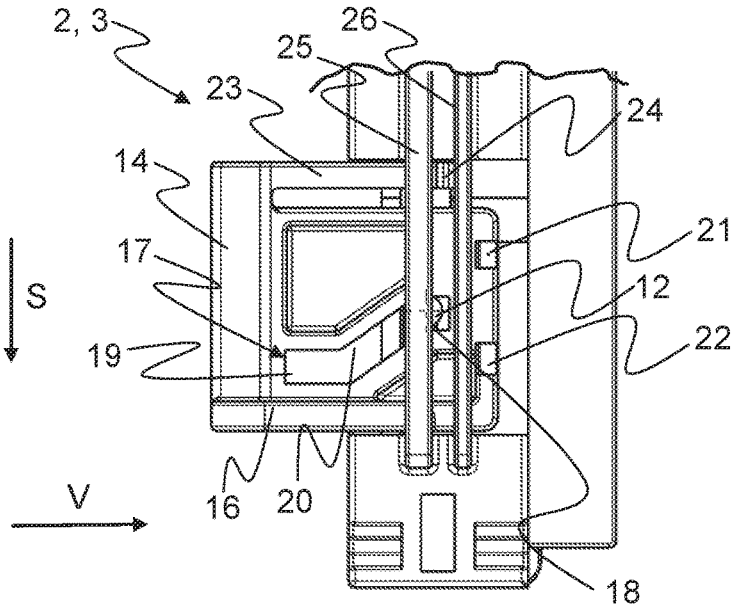
FIG. 5 is a lateral view of an exemplary plug with a locking slide, shown in a secondary locking position.

FIG. 5 shows a partial section of the plug 2 in a side view in which the locking slide 14 is in its secondary locking position. As shown in FIG. 5, the locking slide 14 is displaced in a displacement direction V relative to the installation position described above (see FIGS. 1 to 4), resulting in the base part 15 being situated closer to the exterior of the plug casing 3. In this position, the position-assurance lug 24 of the position-assurance arm 23 is arranged and engages between the first longitudinal rib 25 and the second longitudinal rib 26 of the plug casing 3. Thus, the locking slide 14 performs the function of a CPA of the plug connector 1, since continued displacement of the locking slide 14 in the direction of displacement V is blocked by the engagement. Furthermore, the two detent lugs 21, 22 are arranged behind the second longitudinal rib 26 in the direction of displacement V. The detent lugs 21, 22 are beveled to permit movement past the second longitudinal rib 26 on being displaced from the installation position into the secondary locking position.

FIG. 5 reveals that the axial end of the locking bolt 12 is received in the guide slot 17 of the locking slide 14 in the secondary locking position. The locking bolt 12 in this case is located in the first linear segment 18.

Figure 6:
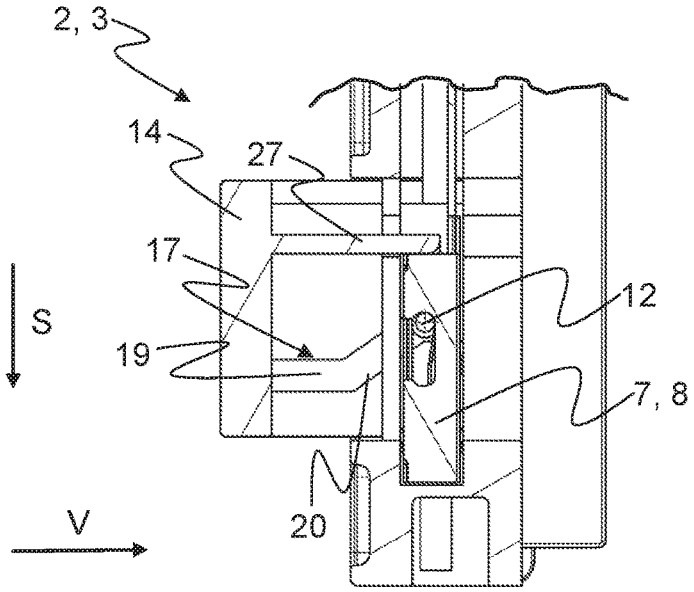
FIG. 6 is a sectional view of an exemplary plug showing a secondary locking of an electrical contact part accommodated in a contact chamber.

FIG. 6 shows a side view of a partial cut through a portion of the plug 2. The locking slide 14 has a secondary locking rib 27 on an inner side, i.e. on a side facing away from one of the detent lugs 21, 22. In the secondary locking position shown here, the secondary locking rib 27 undercuts the contact part 7 located in the contact chamber 6, with the result that it is secondarily locked by the locking slide 14. The secondary locking rib 27 thus lies on a face of the contact part 7. The secondary locking rib 27 here presses the contact part 7 against the plug casing 3. Prior to the secondary locking, for example, the contact part 7 is primarily locked in the contact chamber 6 by a retaining tab attached to it (not shown).

Figure 7:
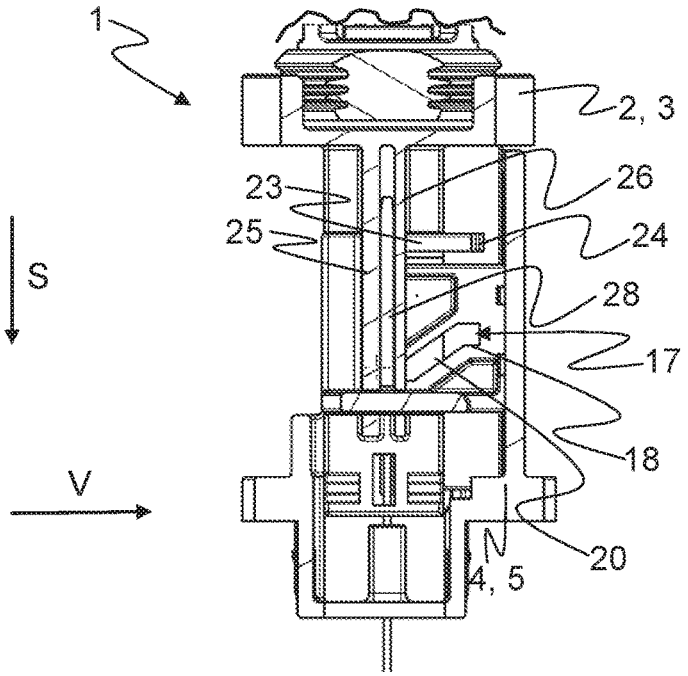
FIG. 7 is a partial section through an exemplary plug and a socket connected to it, in which an unlocking rib of the socket is guided between two longitudinal ribs of the plug.
Figure 8:
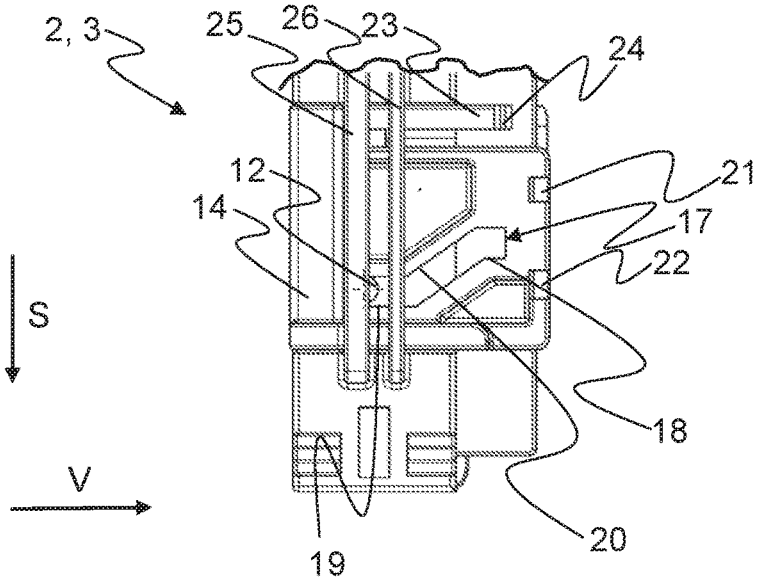
FIG. 8 is a lateral view of a partial section of the electrical plug connector, with a locking slide in a locking position.

FIG. 7 shows a side view of a cut through a section of the plug 2 and the socket 4 in an intermediate position between the secondary locking position and a locking position of the locking slide 14 (see FIG. 8). The socket 4 has an unlocking rib 28 on its casing 5 that projects into the casing interior. The unlocking rib 28 in FIG. 7 is arranged and guided between the first longitudinal rib 25 and the second longitudinal rib 26 of the plug casing 3. As such, the unlocking rib 28 is arranged and embodied in such a manner that it can engage between the longitudinal ribs 25, 26. The unlocking rib 28 deflects the position-assurance arm 23 in the secondary locking position of the locking slide 14 (into the drawing plane of FIG. 7) to an extent that permits the position-assurance lug 24 to be pushed out of engagement with the second longitudinal rib 26. The locking slide 14 can thus be moved from the secondary locking position into the locking position only when the position-assurance arm 23 is deflected and released. The locking slide 14 and the socket casing 5 thus cooperate to act as a CPA when the plug 2 and the socket 4 are plugged together.

FIG. 8 shows a side view of a partial section of the plug 2 in which the locking slide 14 is in its locking position. In this position the position-assurance lug 24 of the position-assurance arm 23 has already been pushed beyond the second longitudinal rib 26 of the plug casing 3 and is no longer engaged. The base part 15 now abuts the exterior of the plug casing 3 for the most part. In addition, in this locking position, the locking bolt 12 of the contact part 7 will also have been pushed into its locking position when the locking slide 14 is moved through the guide slot 17, whereupon it is held or clamped fast in the second linear segment 19. Here the locking bolt 12 presses against the contact spring 11 on the plug-in contact 10, such that it is held in a friction fit in the receiving space. The inclined plane 20 between the linear segments 18, 19 keeps the pushing force required to move the locking bolt 12 at a relatively low level.

Figure 9:
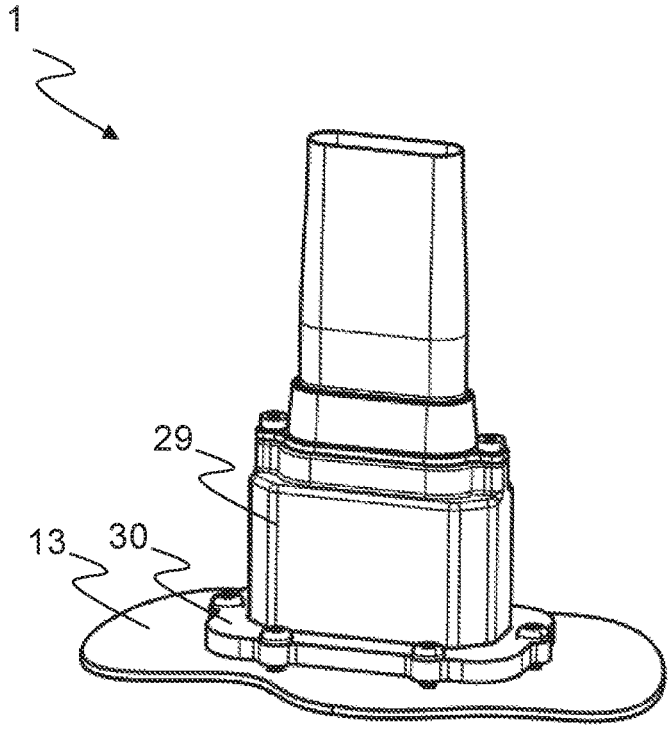
FIG. 9 is a perspective lateral view of an exemplary plug connector, in which a protective housing at least partially encases a plug and socket.

FIG. 9 shows a perspective front view of the plugged-together and locked plug connector 1 with a protective housing 29 of aluminum or an aluminum alloy covering the plug connector 1. The protective housing 29 shields the plug connector 1 from electric or electromagnetic fields. The protective housing 29 at least partially encases the plug 2 and the socket 4. The protective housing is affixed in a friction fit via an attachment flange 30 to a counterpart 13. The attachment flange 30 positively grips the support flange of the socket casing 4, which in turn is supported on the counterpart 13. The protective housing 29 also engages the plug casing 3 in a positive fit.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

LIST OF REFERENCE NUMBERS

1 plug connector
2 plug
3 plug casing
4 socket (header)
5 socket casing
6 contact chamber
7 electrical contact part
8 sleeve
9 receiving space
10 plug-in contact(s)
11 contact spring
12 locking bolt
13 counterpart (e.g., housing)
14 locking slide
15 base part
16 side part(s)
17 guide slot
18 first linear segment
19 second linear segment
20 inclined plane
21 first detent lug
22 second detent lug
23 position-assurance arm
24 position-assurance lug
25 first longitudinal rib
26 second longitudinal rib
27 secondary locking rib
28 unlocking rib
29 protective housing
30 attachment flange
S plugging direction
V displacement direction

What is claimed is:

1. An electrical plug connector for a vehicle, comprising:

a plug comprising a plug casing having a contact chamber;

an electrical contact part arranged in the contact chamber, the contact part comprising a locking bolt for releasably attaching a plug-in contact to the contact part;

a socket configured for coupling to the plug, the socket comprising a socket casing and the plug-in contact, the socket receiving the plug in a first direction; and a locking slide attached to the plug casing, the locking slide comprising a guide slot extending substantially transversely to the first direction, the guide slot having an inclined plane for guiding the locking bolt of the contact part in a displacement direction transverse to the first direction into a locking position, the locking position locking the plug to the socket.

2. The plug connector according to claim 1, wherein the guide slot comprises a first linear segment for receiving the locking bolt and a second linear segment, the inclined plane of the guide slot being arranged between the first linear segment and the second linear segment.

3. The plug connector according to claim 1, wherein the inclined plane comprises an angle of inclination of approximately 30° to 60°.

4. The plug connector according to claim 1, wherein the inclined plane comprises an angle of inclination of approximately 45°.

5. The plug connector according to claim 1, wherein the locking slide is configured to lock the contact part in the contact chamber in a secondary locking position upstream of the locking position.

6. The plug connector according to claim 1, wherein the locking slide comprises a secondary locking rib on a side facing the plug casing, the secondary locking rib being configured to lock the contact part in the contact chamber.

7. The plug connector according to claim 1, wherein the plug casing comprises a first longitudinal rib extending in the first direction and a second longitudinal rib arranged parallel to the first longitudinal rib, the first and second longitudinal ribs configured to interact with the locking slide.

8. The plug connector according to claim 7, wherein the locking slide comprises a detent lug configured to engage with at least one of the first longitudinal rib or the second longitudinal rib.

9. The plug connector according to claim 8, wherein the detent lug engages behind the second longitudinal rib viewed in the displacement direction, in a secondary locking position upstream of the locking position.

10. The plug connector according to claim 8, wherein the detent lug engages behind the first longitudinal rib viewed in the displacement direction, in an installation position upstream of the locking position.

11. The plug connector according to claim 10, wherein the contact chamber is open in the installation position.

12. The plug connector according to claim 7, wherein the locking slide comprises a resilient position-assurance arm engaged with at least one of the first longitudinal rib or the second longitudinal rib, the position-assurance arm being releasable from the engaged longitudinal rib by deflection to permit displacement into the locking position.

13. The plug connector according to claim 12, wherein the socket casing comprises an unlocking rib configured to release the position-assurance arm from the engaged longitudinal rib.

14. The plug connector according to claim 13, wherein the unlocking rib is guided between the first and the second longitudinal ribs when the plug is connected to the socket.

15. The plug connector according to claim 1, wherein the socket and the coupled plug are at least partly encased in a protective housing.

16. The plug connector according to claim 1, wherein the plug connector is a high-voltage plug connector.

17. An electrical plug for a high-voltage plug connector system in a vehicle, the electrical plug comprising:

a plug casing having a contact chamber for encompassing at least part of an electrical contact part, the electrical part comprising a locking bolt; and a locking slide attached to the plug casing, the locking slide comprising a guide slot extending substantially transversely to a first direction, the guide slot having an inclined plane for guiding the locking bolt in a displacement direction transverse to the first direction into a locking position, the locking position locking the plug to a socket configured to receive the plug in the first direction.

18. The electrical plug according to claim 17, wherein the guide slot comprises a first linear segment for receiving the locking bolt and a second linear segment, the inclined plane of the guide slot being arranged between the first linear segment and the second linear segment.

19. The electrical plug according to claim 17, wherein:

the plug casing comprises a first longitudinal rib extending in the first direction and a second longitudinal rib arranged parallel to the first longitudinal rib, the first and second longitudinal ribs configured to interact with the locking slide; and the locking slide comprises a detent lug configured to engage with at least one of the first longitudinal rib or the second longitudinal rib.

20. The electrical plug according to claim 19, wherein the locking slide comprises a resilient position-assurance arm engaged with at least one of the first longitudinal rib or the second longitudinal rib, the position-assurance arm being releasable from the engaged longitudinal rib by deflection to permit displacement into the locking position.

* * * * *